US005473981A

United States Patent [19]

Mazaki

[11] Patent Number: 5,473,981

[45] Date of Patent: Dec. 12, 1995

[54] SCREEN PRINTING PLATE

[75] Inventor: Naokazu Mazaki, Aichi, Japan

[73] Assignee: Asahi Glass Company Ltd., Tokyo, Japan

[21] Appl. No.: 275,524

[22] Filed: Jul. 15, 1994

[30] Foreign Application Priority Data

Jul. 16, 1993 [JP] Japan ..... 5-198996

[51] Int. Cl.[6] ..... B41F 15/36

[52] U.S. Cl. ..... 101/128.21; 101/129; 428/225; 428/229; 428/257; 428/258; 428/212; 428/213; 139/383 R; 139/383 A

[58] Field of Search ..... 101/127, 128.21, 101/128.4, 129; 428/225, 229, 257, 258, 212, 213; 139/383 R, 383 A

[56] References Cited

U.S. PATENT DOCUMENTS

| | | | |
|---|---|---|---|
| 3,322,163 | 5/1967 | Hughes | 139/383 R |
| 3,756,288 | 9/1973 | Seo et al. | 139/383 R |
| 4,096,308 | 6/1978 | Reed | 428/247 |
| 4,749,611 | 6/1988 | Furuya | 428/229 |
| 4,909,284 | 3/1990 | Kositzke | 139/383 A |
| 4,959,260 | 9/1990 | Tomoyasu et al. | 428/255 |
| 5,074,339 | 12/1991 | Vöhringer | 139/383 A |
| 5,131,434 | 7/1992 | Krummheuer et al. | 139/383 R |
| 5,388,509 | 2/1995 | Cutcher | 101/128.21 |
| 5,390,595 | 2/1995 | Cutcher | 101/128.21 |

*Primary Examiner*—Edgar S. Burr
*Assistant Examiner*—Lynn D. Hendrickson
*Attorney, Agent, or Firm*—Oblon, Spivak, McClelland, Maier, & Neustadt

[57] ABSTRACT

In a woven cloth type screen printing plate for screen process printing, the screen printing plate has a first area through which a smaller amount of ink is passed and a second area other than the first area wherein each of component yarns A disposed in the first area is composed of an n (n≧2) number of monofilaments, each having a diameter of d and the monofilaments being arranged in parallel without any gap, and each of component yarns B disposed in the second area is composed of a monofilament, having a diameter larger than d, arranged in the same direction as the component yarns A.

4 Claims, 1 Drawing Sheet

SCREEN PRINTING PLATE

BACKGROUND OF THE INVENTION

1. Field of the Invention

The present invention relates to a screen printing plate used for screen process printing.

2. Discussion of Background

There has been widely used a technique of directly printing an electric conductive portion for an electric heater on a glass plate and baking it to prepare a safety glass panel for a vehicle. The electric heater is for the purpose of anti-fogging. The electric conductive portion comprises an element line portion which generates heat for anti-fogging and a bus bar portion for supplying power to the element line portion.

An advantage of the printing technique with use of the screen printing plate is to provide a printed layer having a uniform thickness. Various improvements have been conducted to provide a uniform thickness for the printed layer.

As an anti-fogging method for a safety glass for a vehicle, there has been known a technique that a current is passed through a fine line (an element line) obtained by printing and baking silver paste. There has been also known to use a screen printing method to form the fine line (element line) of silver paste to have a uniform thickness so that heat generated from the element line can be uniform.

In the conventional technique, however, the bus bar portion for supplying power to the element line was apt to generate heat higher than the element line portion because there is a demand of narrowing the width of the bus bar portion in designing the structure of screen printing plates and, therefore, a power density in the bus bar portion is high (the upper limits of temperature in the element line portion and the bus bar portion are determined in Industrial Standards). In order to solve the above-mentioned problem in the screen printing method wherein the thickness of the silver paste layer of the element line portion and the bus bar portion is uniform, the layer thickness of the bus bar portion has to be increased by repeating printing operations two times or more to thereby reduce the power density in the bus bar portion. However, there is a disadvantage that the number of stage of printing (number of times of printing) is increased.

Further, the thickness of the layer of ink is determined by a condition of ink, a condition of printing and a condition of the screen printing plate. There has been known that the thickness of the layer of ink can be changed by adjusting the layer thickness of emulsion and the rate of opening of a gauze when the screen process printing is used. The method of changing the layer thickness of ink by adjusting the layer thickness of emulsion has already been practiced.

In the later method, the condition of the gauze is determined depending on the diameter of yarns constituting the gauze and the density of textile (the number of yarns per inch) which determine the thickness of the gauze and the rate of opening.

Further, Japanese Examined Patent Publication No. 39470/1980 discloses a method of reducing an amount of ink to be applied to a specified area by using a multifilament structure. However, the multifilament structure had problems as follows. When the screen process printing was conducted, cutting or fraying of yarns was resulted. A piece of cut yarn or a fraying yarn adversely influenced the printed surface. Further, ink remained in multifilaments even when the screen printing plate was washed after printing operations, and it was difficult to use continuously the screen printing plate.

SUMMARY OF THE INVENTION

It is an object of the present invention to provide a screen printing plate wherein the thickness of the layer of ink can be changed at a specified portion in a once time printing operation without adversely influencing the printed surface.

The foregoing and other objects of the present invention have been attained by providing a woven cloth type screen printing plate for screen process printing characterized in that a screen printing plate has a first area supplied through which a smaller amount of ink is passed and a second area other than the first area wherein each of component yarns A disposed in the first area is composed of an n ($n \geqq 2$) number of monofilaments, each having a diameter of d and the monofilaments being arranged in parallel without any gap, and each of component yarns B disposed in the second area is composed of a monofilament, having a diameter larger than d, arranged in the same direction as the component yarns A.

The present invention is featurized by a woven structure of a gauze as a major material for constituting the screen printing plate wherein the thickness of the gauze is changed by adjusting the diameter of yarns and a specified state of weaving.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
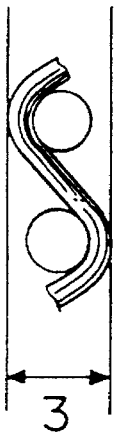
FIG. 1*a* is an enlarged cross-sectional view partly omitted of an area of a screen printing plate according to the present invention wherein a smaller amount of ink is passed through the area.
FIG. 1*b* is an enlarged plane view of the area through which a smaller amount of ink is passed.
Figure 1:
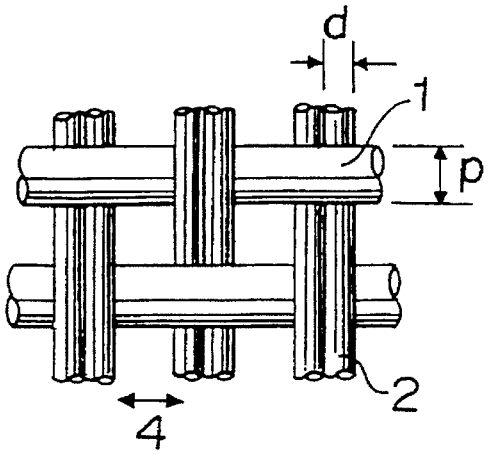

Preferred embodiments of the present invention will be described with reference to the drawings wherein the same reference numerals designate the same or corresponding parts.

FIG. 1 shows an area in a woven cloth type screen printing plate through which a smaller or a limited amount of ink is passed, wherein warp yarns 2 which constitute first component yarns and weft yarns 1 which constitutes second component yarns are woven into a flat textile structure.

As shown in FIG. 1, the area through which a smaller amount of ink is passed, is composed of the weft yarns 1 and the warp yarns 2. In this case, the warp yarns 2 correspond to component yarns A and each of the warp yarns 2 is composed of an n ($n \geqq 2$) number of monofilaments having a diameter of d which are arranged in parallel and mutually contact with each other without any gap. Although the diameter d of the monofilament is not particularly limited, use of monofilaments having a diameter of d=20 μm–40 μm is preferable since fraying of the yarns can be effectively prevented. Further, the number of the monofilaments is not particularly limited. However, a number n=2–3 is preferable in the same reason as above.

In FIG. 1, description is made as to the warp yarns 2 corresponding to the component yarns A. However, the weft yarns 1 may correspond to the component yarns A.

Figure 2:
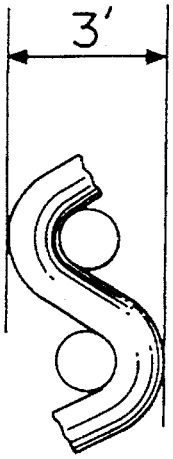
FIG. 2*a* is an enlarged cross-sectional view partly omitted of an area other than the area shown in FIG. 1 of the screen printing plate of the present invention.
FIG. 2*b* is an enlarged plane view of the portion shown in FIG. 2*a*.
Figure 2:
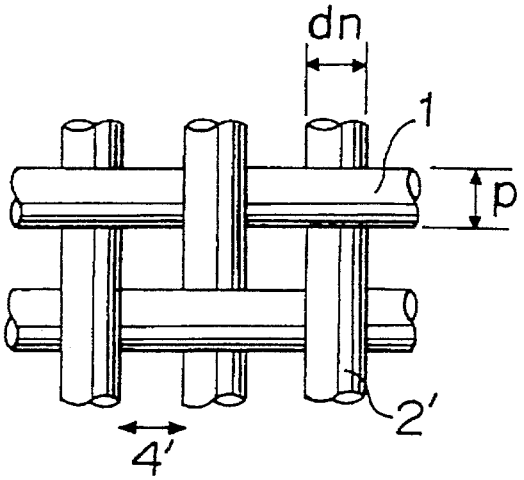

On other hand, as shown in FIG. 2, a second area which is other than the first area through which a smaller amount of ink is passed, of the screen printing plate is formed of the weft yarns 1 and warp yarns 2'. In this case, the warp yarns 2' correspond to the component yarns B. Each of the warp yarns 2' is composed of a monofilament having a diameter larger than d. The diameter of the component yarns B is not particularly limited as long as the diameter of the component yarns B is larger than the diameter of the component yarns A. However, it is preferable that the component yarns B have a diameter in a range of 60 μm–120 μm from the viewpoint that a stable layer thickness is obtained in the area of the screen printing plate other than the area through which a smaller amount of ink is passed. When the diameter of the component yarns B is made excessively large, the gauze will be broken because the difference between the diameter d of the monofilaments constituting the component yarns A and the diameter of the component yarns B is large, although the layer thickness is large. Accordingly, the diameter of the component yarns B is preferably n×d.

The distance 4 between a warp yarn 2 and a neighboring warp yarn 2 and the distance 4' between a warp yarn 2' and a neighboring warp yarn 2' are not in particular limited. However, it is preferable to determine the distances to be in a range of 70 μm–140 μm since ink can be smoothly applied. Further, when the distance 4 is equal to the distance 4', the rate of opening of the area through which a smaller amount of ink is passed and the rate of opening of the area other than the area through which a smaller amount of ink is passed are uniform. Accordingly, a uniform quality of print can be obtained.

In the following, an Example will be described. However, the present invention should not be limited to the Example.

EXAMPLE 1

Warp yarns 2 were used for an area through which a smaller amount of ink is passed, to the screen printing plate as shown in FIG. 1. Each of the warp yarns 2 was composed of two parallel monofilaments each having a diameter of 35 μm which were in mutually contact without any gap. Monofilaments each having a diameter P of 50 μm were used for the weft yarns 1.

Monofilaments each having a diameter of 70 μm were used for the warp yarns 2' of the screen printing plate at the area other than the area through which a smaller amount of ink was passed, and monofilaments each having a diameter P of 50 μm were used as the weft yarns 1, as shown in FIG. 2. The distance 4 between a warp yarn 2 and a neighboring warp yarn 2 in the area through which a smaller amount of ink was passed was 80 μm, and the distance 4' between a warp yarn 2' and a neighboring warp yarn 2' in the area other than area through which a smaller amount of ink is passed was 80 μm.

The thickness of the gauze 3 shown in FIG. 1 could be made thinner than the thickness of the gauze 3' shown in FIG. 2 without changing the rate of opening (v., FIGS. 1 and 2). As a result, an amount of ink supplied by the gauze 3 could be reduced.

Printing was continuously conducted with use of the screen printing plate having the area through which a smaller amount of ink was passed and the area other than the area through which a smaller amount of ink was passed.

COMPARATIVE EXAMPLE 1

A screen printing plate was prepared in the same manner as Example 1 except that conventionally used multifilaments were used as the component yarns A. Namely, a multifilament having a diameter of 70 μm (which was composed of 6 twisted threads) were used as the warp yarns 2. Printing was continuously conducted in the same manner as Example 1.

In both Example 1 and Comparative Example 1, the thickness of the printed layers could be increased at a specified portion in once time printing operation. However, there was found the fraying of yarns in the screen printing plate of Comparative Example 1 during the continuous printing. However, there was no change in the screen printing plate of Example 1, irrespective of the continuous printing, under the same conditions and the same number of times of printing operations as Comparative Example 1.

After the printing operations, the screen printing plates were washed. In the screen printing plate of Comparative Example 1, the ink remained in the multifilaments each composed of twisted threads and it was impossible to completely remove the ink. However, in the screen printing plate of Example 1, there was no ink remaining in the monofilaments which are arranged in parallel without any gap.

With use of the screen printing plate of the present invention, the thickness of the printed layer can be increased at a specified portion (a bus bar portion) in a once time printing operation. The same effect as having obtained by using a conventional two stage printing technique can be obtained.

In the present invention, since the fraying of the yarns can be minimized, there is little possibility of adversely influencing the printed surface. Further, by washing the screen printing plate after printing operations, the plate can be continuously used without a risk of remaining ink in the screen plate.

In the conventional technique using the multifilaments, yarns are flattened at intersections of the weft and the warp yarns to thereby cause scattering in the diameter of yarns, whereby it is difficult to obtain a desired rate of opening. However, according to the screen printing plate of the present invention, a desired rate of opening can be obtained without causing the scattering of the diameter of yarns, and accordingly, it is possible to assure a predetermined thickness of the printed layer.

Obviously, numerous modifications and variations of the present invention are possible in light of the above teachings. It is therefore to be understood that within the scope of the appended claims, the invention may be practiced otherwise than as specifically described herein.

What is claimed is:

1. A woven cloth type screen printing plate for screen process printing comprising a screen printing plate having a first area through which a first amount of ink is passed and a second area other than the first area through which a second amount of ink larger than the first amount is passed, wherein each of first component yarns disposed in the first area is composed of n number of monofilaments, wherein $n \geqq 2$, each of the monofilaments having a diameter of d and the monofilaments being arranged in parallel without any gap, and each of second component yarns disposed in the second area is composed of a monofilament, having a diameter larger than d, arranged in the same direction as the first component yarns.

2. The screen printing plate according to claim 1, wherein a distance between adjacent ones of said first component yarns each composed of an n number of monofilaments arranged in parallel without any gap, is the same as a distance between adjacent ones of said second component yarns which are positioned in the same direction as the first component yarns in the first area.

3. The screen printing plate according to claim 1, wherein the diameter of the second component yarn is $n \times d$, wherein $n \geqq 2$.

4. The screen printing plate according to claim 2, wherein the diameter of the second component yarn is $n \times d$, wherein $n \geqq 2$.

* * * * *